US005826791A

United States Patent [19]

Broughton

[11] Patent Number: 5,826,791

[45] Date of Patent: Oct. 27, 1998

[54] PROCESS FOR MANUFACTURING A RAILROAD RAIL SUPPORT

[76] Inventor: Amos W. Broughton, 5645 Persimmon Ave., Temple City, Calif. 91780

[21] Appl. No.: 553,020

[22] Filed: Nov. 3, 1995

[51] Int. Cl.[6] ..... E01B 3/46

[52] U.S. Cl. ..... 238/35; 238/29; 238/83; 238/84; 238/117

[58] Field of Search ..... 238/29, 35, 55, 238/83, 84, 105, 115, 117

[56] References Cited

U.S. PATENT DOCUMENTS

| | | | |
|---|---|---|---|
| 3,190,607 | 6/1965 | Sonneville | 238/84 |
| 3,371,866 | 3/1968 | Sonneville | 238/84 |
| 3,550,850 | 12/1970 | Sonneville | 238/35 |
| 3,893,619 | 7/1975 | Bruner | 238/83 |

FOREIGN PATENT DOCUMENTS

| | | | |
|---|---|---|---|
| 154259 | 9/1985 | European Pat. Off. | 238/84 |
| 2549111 | 1/1985 | France | 238/84 |
| 6002301 | 1/1994 | Japan | 238/83 |

*Primary Examiner*—S. Joseph Morano

[57] ABSTRACT

A railroad rail support includes a first and second horizontally oriented rubber tire having a circumferential tread, a top sidewall including a top rim bead and a bottom sidewall having a bottom rim bead, said bottom sidewall and bottom rim bead being adjacent to a railroad roadbed. First and second rail support members within each tire have a top surface in the plane of the top rim bead and a bottom surface in the plane of the bottom rim bead, and include a top plate and a plurality of tubular channels extending downwards from said top plate to the bottom surface. A concrete matrix fills each rubber tire and retains the rail support within the rubber tire. Railroad spikes are installed into the tubular channels have heads overlapping the opposed edges of the bottom flange of a first and a second railroad rail. Each spike is locked into its respective tubular channel by extending downwards in a generally vertical direction, with a second contiguous portion at an angle of at least 30° from the vertical direction to said first portion. A female threaded member retained within each rail support member is on a common horizontal axis at a right angle to the rails, the female threaded members extending through each respective tire tread. A rail spacing adjustment has a first end extending into the first rail support female threaded member and has a right-hand thread and having a second end extending into the second rail support female threaded member and having a left-hand thread.

13 Claims, 8 Drawing Sheets

PROCESS FOR MANUFACTURING A RAILROAD RAIL SUPPORT

BACKGROUND OF THE INVENTION

In railroad track installations, the steel railroad rails are generally fastened with steel railroad spikes to supporting creosote-saturated wooden cross-ties, the latter of which are laid in parallel fashion at right angles to the steel rails on a roadbed consisting of packed rock aggregate in the following manner:

A steel plate of the same width as the horizontal width of the wooden cross-tie, and generally twice as long horizontally as the width of the steel railroad rail bottom flange, is centered between the steel railroad rail bottom flange and the underlying wooden cross-tie. This steel plate has a number of square holes in the exposed portion on either side of the portion underneath the steel railroad rail bottom flange. Each hole is large enough to allow entry of a steel railroad spike to pass through. The holes are spaced to allow the bottom flange of the railroad rail to fit between them, and are close enough to the edge of the railroad rail flange to permit the head of the steel railroad spike to engage the rail flange when the spikes are driven through the holes in the steel plate into the underlying wooden cross-tie, thus anchoring the railroad rail to the wooden cross-tie. Wooden cross-ties split when the railroad spikes are driven into them, causing them to loosen.

Wooden cross-ties are flexible, and deflect downwards under the vertical load imposed through the railroad rails by a passing train at the area just under the steel support plates, but not under the portion of the wooden cross-tie that lies between the two parallel railroad rails. Prolonged loosening of the railroad spikes eventually allow the railroad rails to move apart, with danger of train derailment.

The high localized load imposed by a passing train on the railroad rails causes deflection of the cross-tie at the area directly under the steel plate, pushing the underlying packed rock aggregate downwards, and loosening the steel railroad spikes in the wooden cross-tie. Attempts to maintain an evenly packed aggregate roadbed are costly, requiring repeated tamping of the aggregate to restore the roadbed directly underneath the railroad rail cross-tie at the steel plate area.

Wooden railroad rail cross-ties also dry out over periods of time, which further aggravates the splitting of the wood in the area of the driven railroad spike. The present procedure for overcoming the drying-out of the wooden cross-ties includes re-creosoting of the wooden cross-ties by spraying creosote directly on the entire roadbed. This pollutes the ground, and eventually this known carcinogen, creosote, leaches into the underlying groundwater aquifers. Over time, the creosote contamination of groundwater aquifers can pose an environmental threat to human health.

The cost of re-ballasting roadbeds, and re-driving or replacing loose steel railroad spikes, creosoting entire railroad roadbeds for in situ treatment of wooden railroad cross-ties and eventual replacement of the wooden crossties, is one of the major maintenance costs of the nation's railroad corporations. The hazard of loosened railroad spikes constitute the primary reason for derailments of railroad trains.

Prior art shows that inventors as far back as Wolfe, U.S. Pat. No. 790,670 in 1905 and Wessels, U.S. Pat. No. 972,303 in 1910 recognized this problem and attempted alleviation with the use of concrete railroad crossties. Immediate problems occurred with anchoring the steel railroad rails to the concrete, as evidenced by a number of following patents, such as Maas, U.S. Pat. No. 1,069,447, Yeomans, U.S. Pat. No. 1,795,817 and Waltz, in U.S. Pat. No. 2,250,785. Problems of high initial installation cost, security, high ongoing maintenance, and aquifer contamination remain despite past prior art efforts.

Attempts to prolong the life of existing wooden crossties by the installation of covers have been addressed by Harmsen, U.S. Pat. No. 4,609,144 in 1986 and attempts to minimize yielding or shifting of roadbed aggregate by filling empty rubber tires with loose aggregate have been addressed by Frohn, U.S. Pat. No. 5,172,858 in 1992.

The present invention addresses the above-mentioned prior art by eliminating wooden crossties, which are a major source of forest depletion; eliminating creosote thus preventing further degradation of drinking water aquifers from this source of pollution; providing a railroad rail support member with a contained railroad spike receptor that prevents railroad spike withdrawal or loosening without any tightening or locking devices; and eliminating any slippage between railroad rail and railroad rail support member by eliminating the use of separate steel support plates previously used for an interface between the railroad rail and the wooden crosstie.

A further advantage of the present invention is the simplification of fastening the railroad rail to the underlying railroad rail support member by virtue of a driven railroad spike into tubular channels which have a bend in them, thus bending the railroad spike when it is driven and thus preventing any upward loosening of the railroad spike when continual vertical compressions and tensions take place by the multiplicity of passing train wheels, The invention touches on the present art of having the bent portion of the railroad spike at least 30° of incline from the vertical plane of the downwardly projecting railroad spike into the tubular channel of the railroad rail support means. Lesser angles of incline tend to allow the railroad spike to withdraw under upward deflection of the railroad rail between compressive loading impacts of the passing train wheels.

This differs significantly from Harmsen, U.S. Pat. No. 3,039,695 and Vivion, U.S. Pat. No. 4,216,904 in that threaded studs are utilized for tightening and holding the totality of their constructions tightly to the railroad rails. The present invention simplifies significantly the total procedure, allowing the railroads companies to utilize the present steel railroad spike, together with conventional spike driving means presently used for driving steel railroad spikes into wooden crossties. No tightening of nuts or re-tightening of same is necessary, as all nuts and bolts are eliminated from the construction.

Other improvements in simplification are achieved by this invention through elimination of such means as Waltz, U.S. Pat. No. 2,250,785 which incorporates the adjustable downward force-locking effect of the weight of the railroad rail to hold the rail tight to the cross-tie, which can loosen and allow railroad rail displacement with the compaction of underlying aggregate by recurring compressive loadings by passing train wheels which can allow individual crossties to slump continually lower to the point where the weight of the railroad rail itself is no longer bearing on the locking construction, thus allowing it to open.

The attempts to prolong the life of existing wooden crossties by the installation of elastomeric covers that have been addressed by Harmsen, U.S. Pat. No. 4,609,144 in 1986 and the attempts to minimize yielding or shifting of roadbed aggregate by filling empty rubber tires with loose aggregate that have been addressed by Frohn, U.S. Pat. No. 5,172,858 in 1992 are applicable to wooden cross-ties, which this invention eliminates in the first instance; and by the incorporation of rubber tires as an integral support member designed to yield maximum load distribution over the roadbed aggregate, thus minimizing the tendency to shift that a "floating" rubber tire, not being an integral part of the railroad cross-tie member would have in the second instance.

SUMMARY OF THE INVENTION

The deficiencies In prior art railroad tie systems are overcome by the present invention, in which a railroad rail support includes a first and second horizontally oriented rubber tire having a circumferential tread, a top sidewall including a top rim bead and a bottom sidewall having a bottom rim bead, said bottom sidewall and bottom rim bead being adjacent to a railroad roadbed. First and second rail support means within each tire have a top surface in the plane of the top rim bead and a bottom surface in the plane of the bottom rim bead, and include a top plate and a plurality of tubular channels extending downwards from said top plate to the bottom surface. A concrete matrix fills each rubber tire and retains the rail support within the rubber tire. Railroad spikes are installed into the tubular channels have heads overlapping the opposed edges of the bottom flange of a first and a second railroad rail. Each spike is locked into its respective tubular channel by extending downwards in a generally vertical direction, with a second contiguous portion at an angle of at least 30° from the vertical direction to said first portion. A female threaded member retained within each rail support means is on a common horizontal axis at a right angle to the rails, the female threaded members extending through each respective tire tread. A rail spacing adjustment has a first end extending into the first rail support female threaded member and has a right-hand thread and having a second end extending into the second rail support female threaded member and having a left-hand thread.

Thus the present invention is locked to the railroad rail whether the rail is raised or lowered, by virtue of the bent railroad spike means within the tubular channel of the invention.

A further advantage of the present invention is the provision for initial lateral rail adjustment and spacing between the two parallel railroad rails by means of a connecting steel end-threaded cross-member, whose threads are self-cleaning, thus eliminating the binding of the threaded lateral-adjustment members utilized in the prior art such as Hayes, U.S. Pat. No. 990,650, by sand and dirt intrusions into the mating threaded areas, and additionally by having the left-hand and right-hand threaded ends of the steel cross-member contained within the individual left-hand and right-hand railroad rail support members which are directly underneath the railroad rails and are basically protected by the circumferential tread area of the rubber tire, the hole in which acts as a fairly tight-fitting "dust cover" to protect the entering male threaded portions of the steel cross-member.

A further advantage of the present invention is the simplification of the design of the lateral adjustment member to permit threaded portions of any size, pitch or length without a change in the diametral dimension of the lateral adjustment member and the elimination of machining threads on the lateral adjustment member. No prior art incorporates this feature. The definite cost advantage of by-passing completely the older methods of thread manufacture, in which steel cross-members were subjected to machining of the thread end portions of the steel cross-member to make the threads, is immediately obvious, as well as the non-binding quality of the present invention when in use and in installation. In the present invention, no machining is necessary. The steel coil spring of the desired thread width and depth is simply slipped on over the steel cross-member outside diameter and is root-welded to the steel cross-member.

A further advantage of the present invention is the simplification of the female receptors of the lateral adjustment member to eliminate machining of threads The older methods of inside diameter machining are very costly, and time-consuming. The present invention utilizes a second coil spring of the same pitch, outside diameter, inside diameter and pitch as the coil spring of the male threaded member on the steel cross-member.

A further advantage of the present invention is the use of the rubber tire as an integral part of the railroad rail support system, for equalization and dampening of all transmitted vibrations from passing trains, thus distributing all applied loadings equally across the roadbed aggregate and minimizing shifting of the aggregate. Vivion, in U.S. Pat. No. 4,216,904 utilizes an elastic material to completely isolate a rail from the cross-tie, requiring a multiplicity of retaining members to prevent extrusion and eventual destruction of the elastomeric material by repeated deflection. The present invention utilizes the sidewalls of the rubber tire, with the steel-reinforced tire rim bead and the steel belting of the tire carcass to prevent extrusion under repeated loading.

A further advantage of the present invention is the use of the rubber tire as a noise dampener, with attendant noise-pollution reductions in populated areas. This noise-reduction attribute is especially applicable to installations within confined spaces, such as subway tunnels. This aspect of application of the invention is not covered under any discovered prior by the inventor, and the use of the rubber tire as an integral part of the invention is a direct participant in the noise reduction of the entire railroad rail support system.

A further advantage of the present invention is the low production cost achieved by using the rubber tire as the manufacturing mold for the railroad rail support system members. The prior art of manufacturing concrete cross-ties embodied the use of discreet, separate molds, which wear out and must be replaced. This invention utilizes the rubber tire portion of the total construction itself to assume the dual role of initially serving as the mold for the wet concrete and also as a mold that will maintain dimensional integrity even under outside vibratory methods of air-elimination to densify the concrete matrix around the railroad rail support means within the construction, while at the same time, in the final cured condition of the concrete matrix, the rubber tire serves as an integral and necessary part of the total invention as described.

Other advantages, including minimal installation and maintenance costs of the railroad rail support members, of this present invention will become apparent in the detailed description of the claims of this invention, which follow.

DETAILED DESCRIPTION OF THE DRAWINGS

Figure 1:
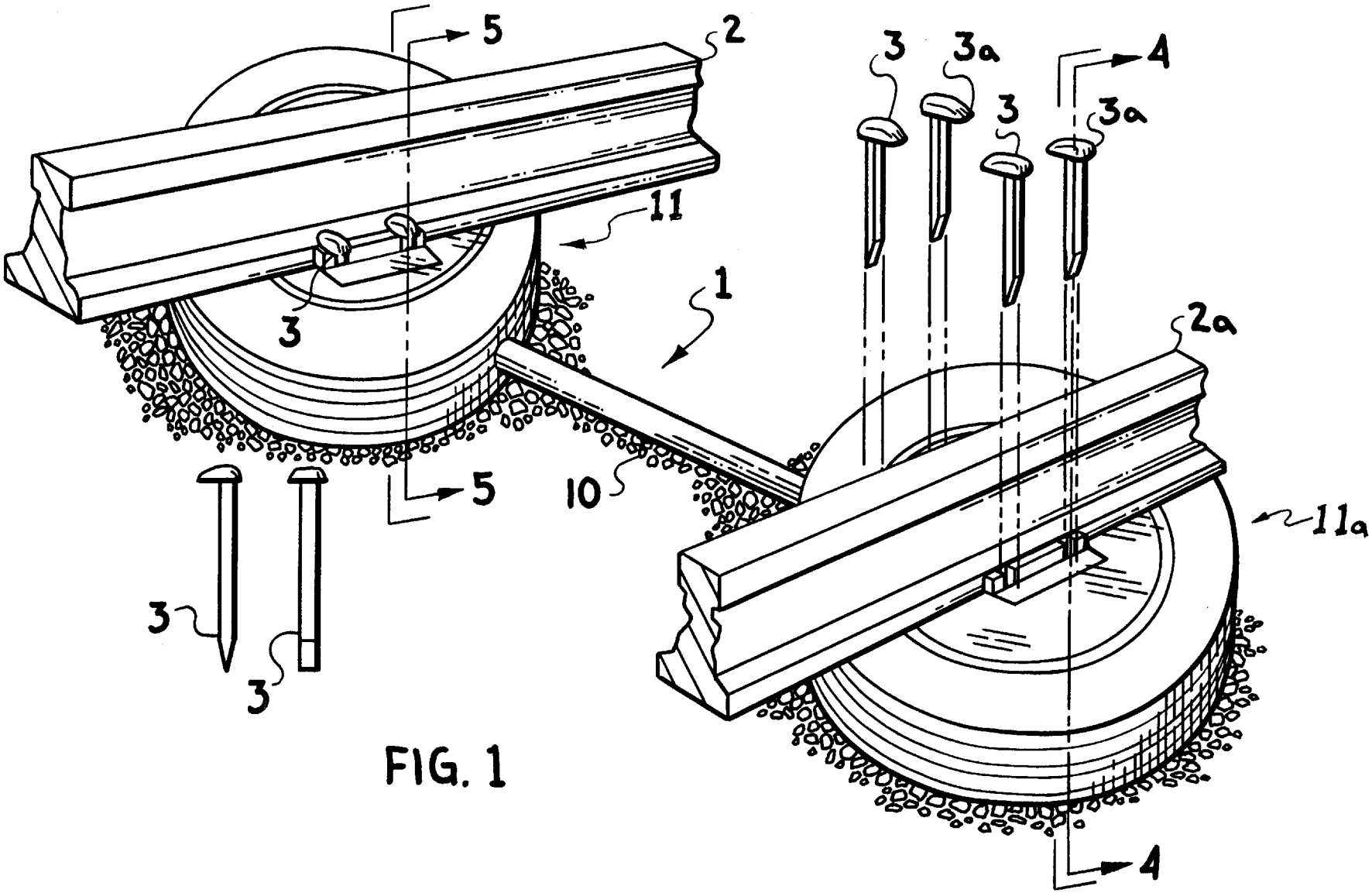
FIG. 1 a perspective view of the railroad rail support system according to the invention.

In FIG. 1 a perspective view of the railroad rail support 1 is shown resting on a railroad roadbed 10 supporting parallel railroad rails 2 and 2*a* resting between railroad rail support rail guides on the railroad rail support; a railroad spike 3 is shown in frontal and side view; a plurality of railroad spike means 3 and 3*a* are shown in their installed position and a plurality of railroad spike means 3 are shown in their respective preinsertion positions; Sections 4—4 and 5—5 are referred to and portrayed in FIGS. 4 and 5.

Figure 2:
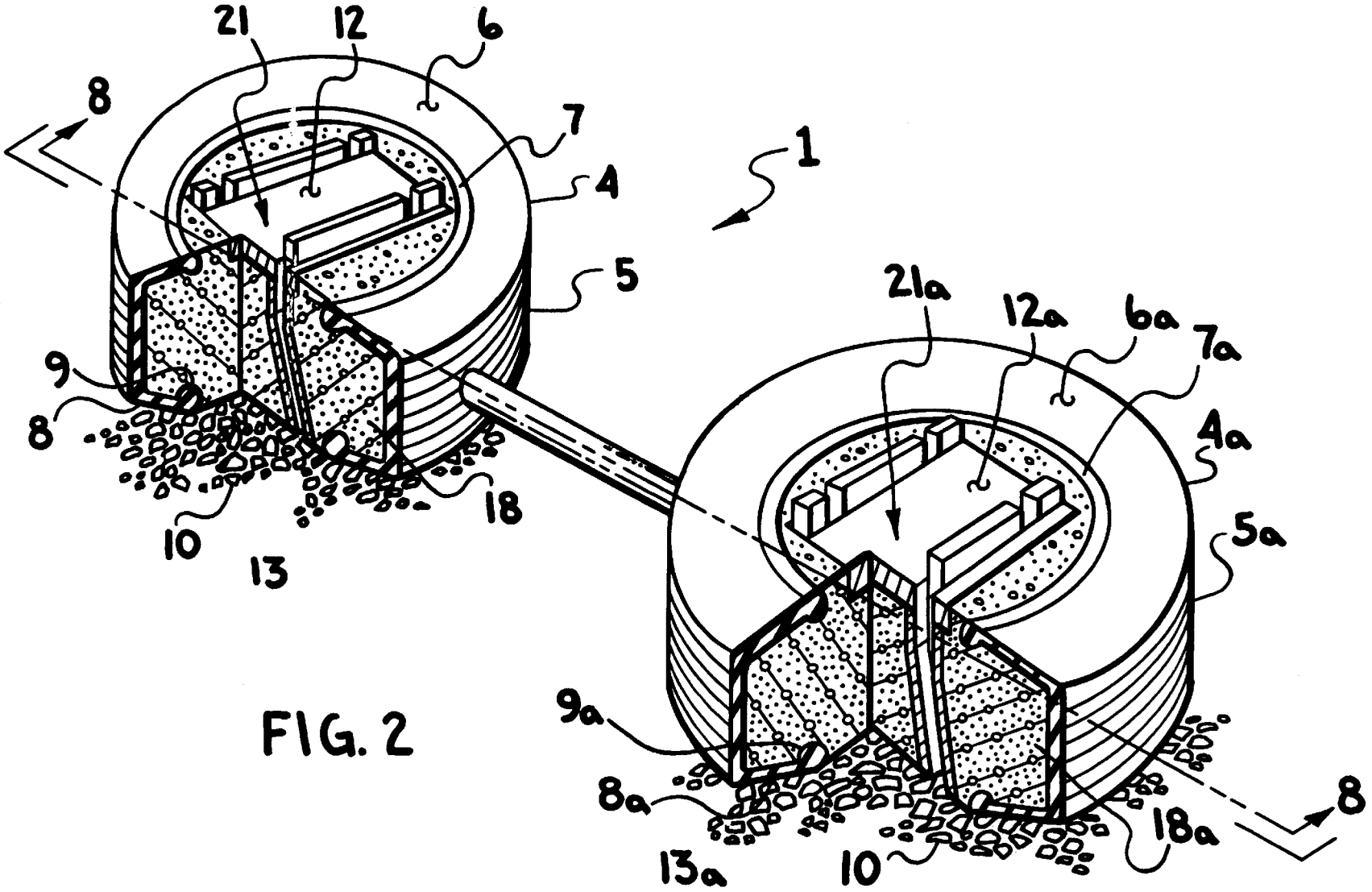
FIG. 2 is a partial cross section of the perspective view of FIG. 1.

In FIG. 2 a perspective view of the railroad support 1 is shown, including a first and second horizontally oriented rubber tire 4 and 4*a*; each having identical vertical laterally-disposed partial cross-sections showing first and second railroad rail support means 21 and 21*a* disposed within each respective tire; each tire having circumferential treads 5 and 5*a*, top sidewalls 6 and 6*a* including top rim beads 7 and 7*a* and bottom sidewalls 8 and 8*a* including bottom rim beads 9 and 9*a*; said bottom sidewalls 8 and 8*a* and bottom rim beads 9 and 9*a* being adjacent to a railroad roadbed 10; said railroad rail support means 21 and 21*a* include a top plate 12 and 12*a* and a plurality of tubular channels extending downwards characterized by 13 and 13*a* from said top plates 12 and 12*a*, being adjacent to a railroad roadbed 10. A concrete matrix 18 and 18*a*, substantially fills each rubber tire 4 and 4*a*, retaining the railroad rail support means 21 and 21*a* within the rubber tires.

Figure 5:
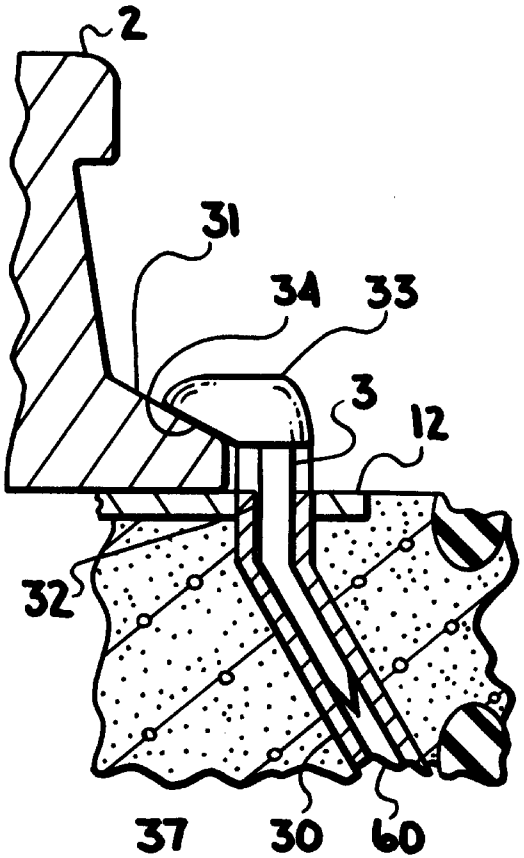
FIG. 5 is a partial cross-sectional view of a portion of FIG. 1, taken along section line 5—5.
Figure 4:
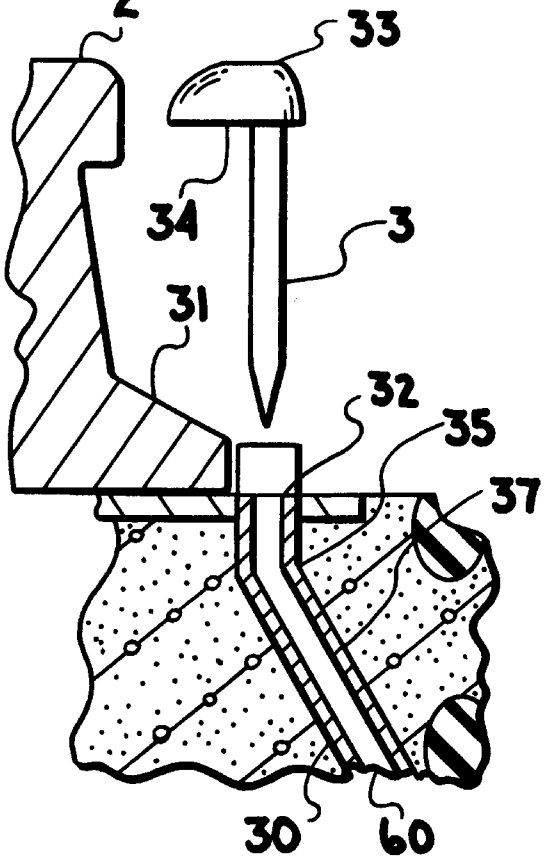
FIG. 4 is a partial cross-sectional view of a portion of FIG. 1, taken along section line 4—4.
Figure 3:
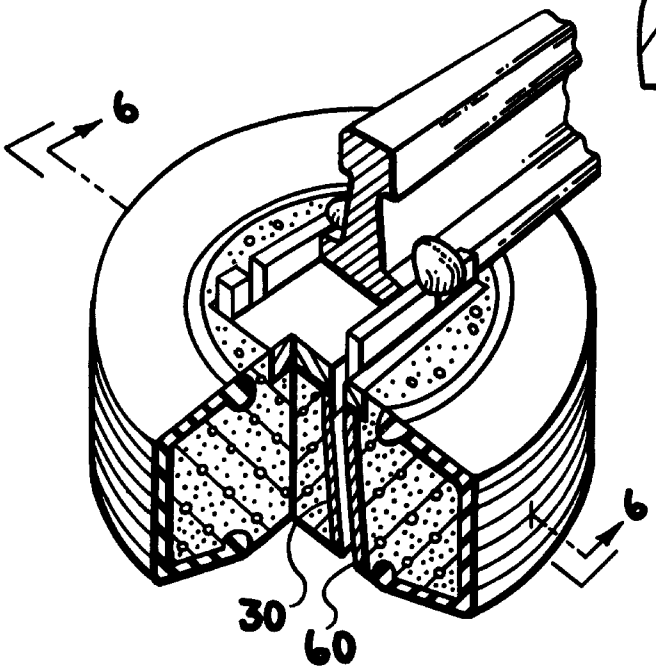
FIG. 3 is a partial cross-sectional view of one railroad rail supports of FIG. 2.

In FIG. 3 a vertical laterally-disposed partial cross-section shows a typical tubular channel 30 with a water drainage means 60, said cross-section is further defined in FIG. 4 and FIG. 5.

In FIG. 4 a railroad spike means 3 is shown positioned above the vertical entry channel 32 of a tubular channel 30. The head 33 of the railroad spike means 3 is disposed with the major exposed bearing undersurface 34 of the railroad spike means head disposed towards the bottom flange 31 of a railroad rail 2. The tubular channel 30 proceeds downwards in a vertical direction 32 and thence in a sloping direction to the bottom surface of the railroad rail support to form a general V-shape. The angle 35 of the sloping portion 37 of the tubular channel 30 is equal to or greater than 30° from the vertical portion plane of the tubular channel and said 30° angle is defined as the means for locking each spike means into the respective tubular channels. The bottom of the tubular channel 30 culminates in an open end which comprises a water drainage means 60.

This continuous transition from the vertical channel 32 to a sloping channel 37 within the tubular channel 30 is essential to the anchoring of the railroad rail 2 to the railroad rail support means 21. Considerable force is required to insert the railroad spike means 3 into the sloping portion 37 of the tubular channel 32. The railroad spike means 3 is bent to the angle of the tubular channel, 35 namely 30° or more from the vertical disposition of the entryway of the railroad spike means 3 into the tubular channel 32.

The length of the sloping portion of the now-bent railroad spike means is greater than the length required for easy withdrawal. This extra bent length prevents the railroad spike means from being withdrawn from the tubular channel 30 without the application of withdrawal force at least equal to and, because of a certain amount of work-hardening of the metal due to the cold bending process, considerably more withdrawal force than would be required to lift the railroad rail support means 21 from the railroad roadbed 10. For that reason the railroad spike means does not loosen during usage.

In FIG. 5 the railroad spike means 3 has been driven into the tubular channel 30 and has followed the angled portion 37 of the tubular channel 30 until the major exposed bearing undersurface 34 of the railroad spike means head 33 is firmly mated with the bottom flange 31 of railroad rail 2, thus effectively locking the railroad rail 2 to the top plate 12 of the railroad rail support means 21. Because there is clearance on certain portions of the driven railroad spike means 3 which can allow water to accumulate, the tubular channel 30 culminates in an open end 60 which comprises a water drainage means.

Figure 6:
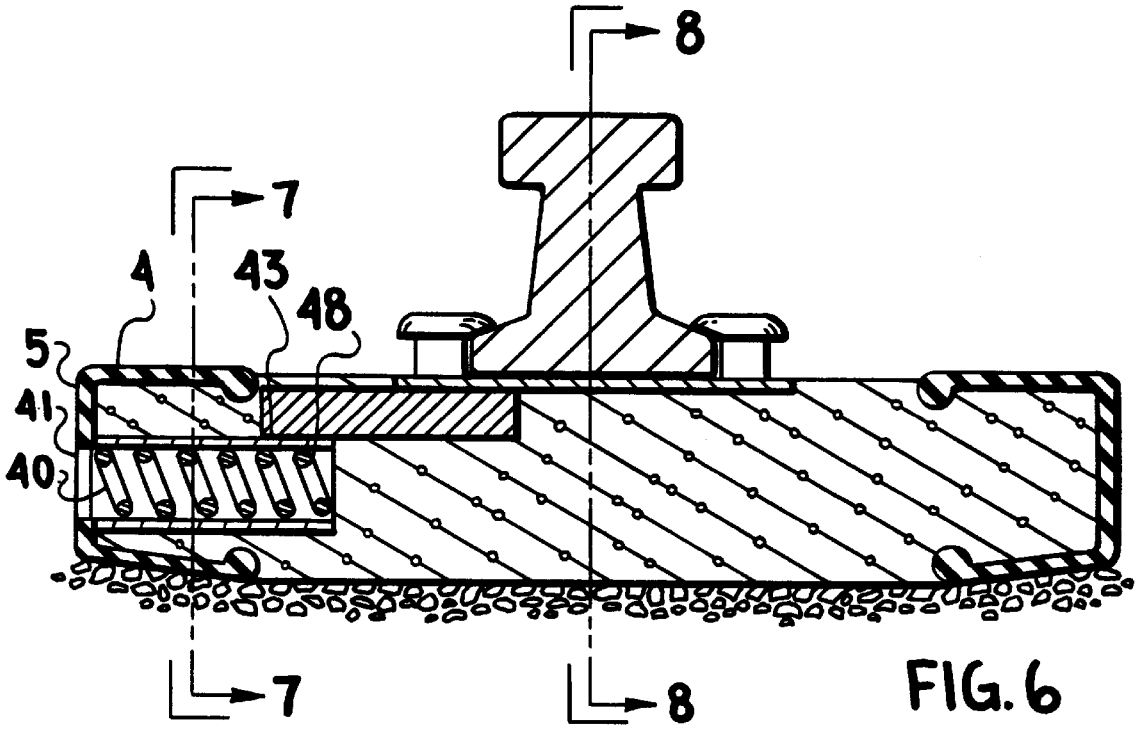
FIG. 6 is a partial cross-sectional view of a portion of FIG. 3, taken along section line 6—6.

In FIG. 6, which is a diametral vertical cross sectional view 6—6 of the railroad rail support 1, a female threaded member 40 is retained within and disposed horizontally, diametrally along the cross sectional horizontal axis of the rail support means 21, with the female threaded member 40 extending through a hole 41 in the circumferential tread 5 of the rubber tire 4. The female threaded member 40 is shown to be a coil spring which is attached to the base 48 of a first generally U-shaped channel 43.

Figure 7:
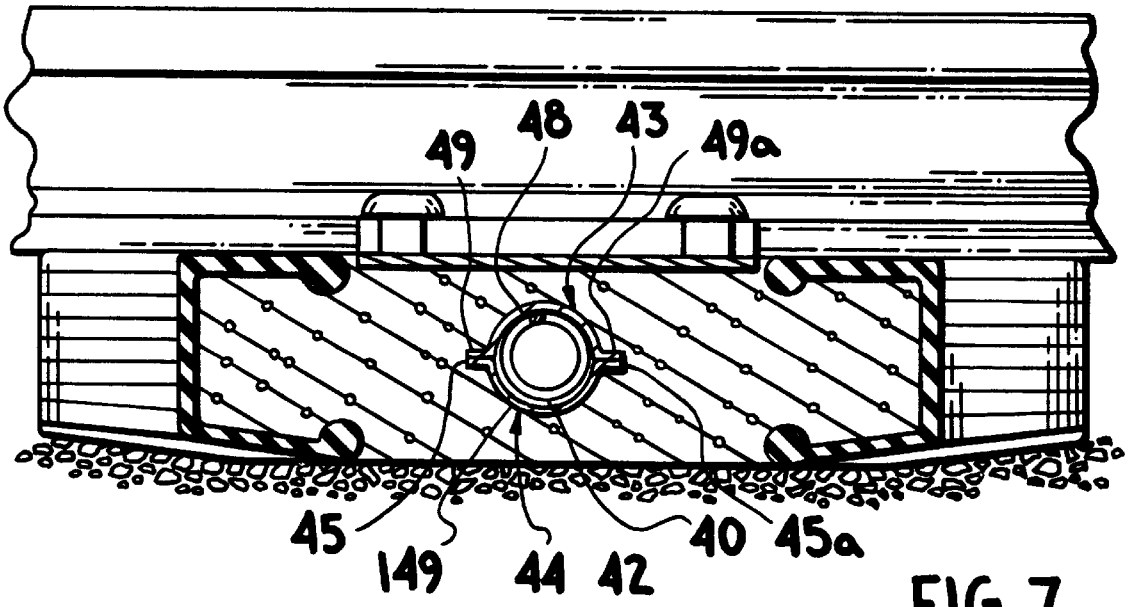
FIG. 7 is a partial cross-sectional view of a portion of FIG. 6, taken along section line 7—7.

In FIG. 7, which is a vertical cross section 7—7 of FIG. 6, a view of the female threaded member 40 in arcuate cross section is shown attached to the base 48 of the first generally U-shaped channel 43, with a second generally U-shaped channel 44 having a base 149 and upstanding sides 45 and 45*a* attached to the depending sides 49 and 49*a* respectively of the first channel. FIG. 7 also shows a space 42 which is formed by the distance between the base of the second channel 44 and the coil spring 40.

Figure 8:
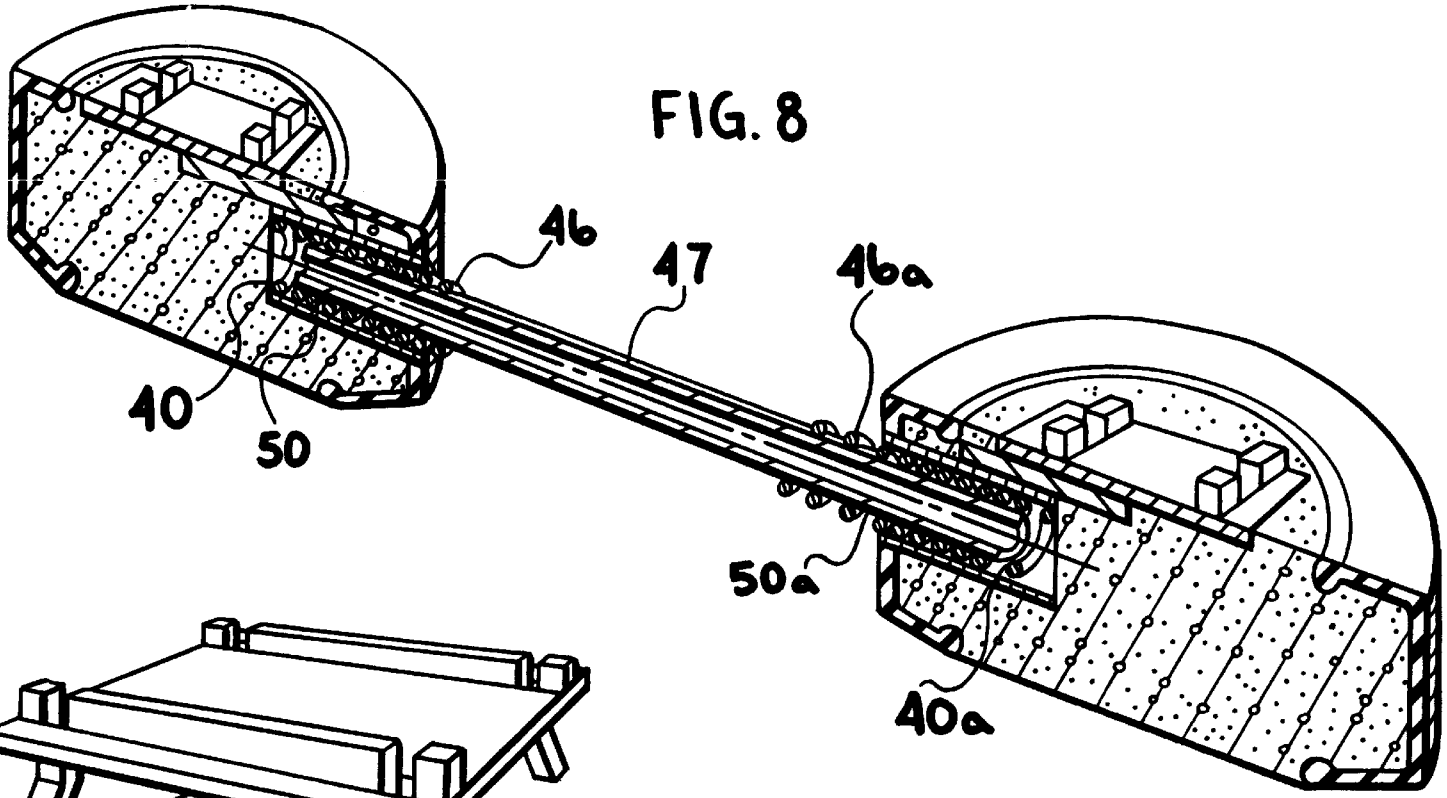
FIG. 8 is a perspective cross-sectional view of FIG. 2, taken along section line 8—8.

In FIG. 8, which is a cross-section 8—8 of FIG. 1, a rail spacing adjustment means comprising a horizontal steel tube 47 is shown, having a first end 50 extending into the first rail support means female threaded member 40 and having a right-hand thread 46, and having a second end 50*a* extending into the second rail support means female threaded member 40*a*, and having a left-hand thread 46*a*. The horizontal steel tube 47 is shown to have external male right hand 46 and left hand 46*a* threaded ends. The threaded ends 46 and 46*a* are comprised of coil springs welded to the horizontal steel tube.

Figure 9:
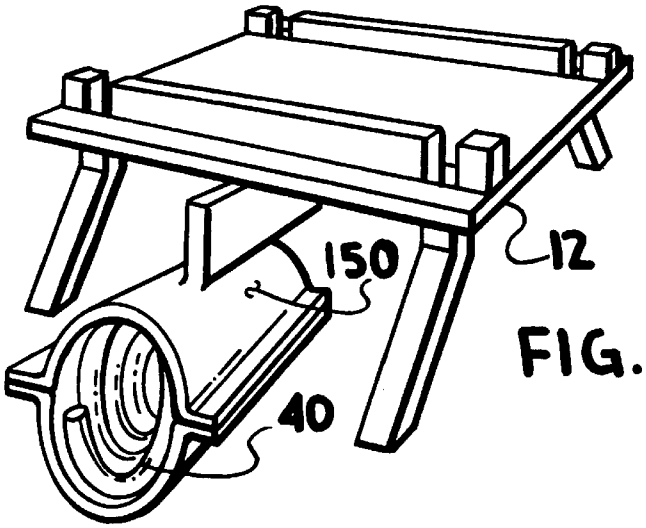
FIG. 9 is a perspective view a rail support means disposed within the railroad rail supports of FIGS. 1 and 2.

In FIG. 9 a perspective view of the female threaded member 40 is shown attached to the base of the top plate 12 by a vertically disposed attachment member 150.

Figure 10:
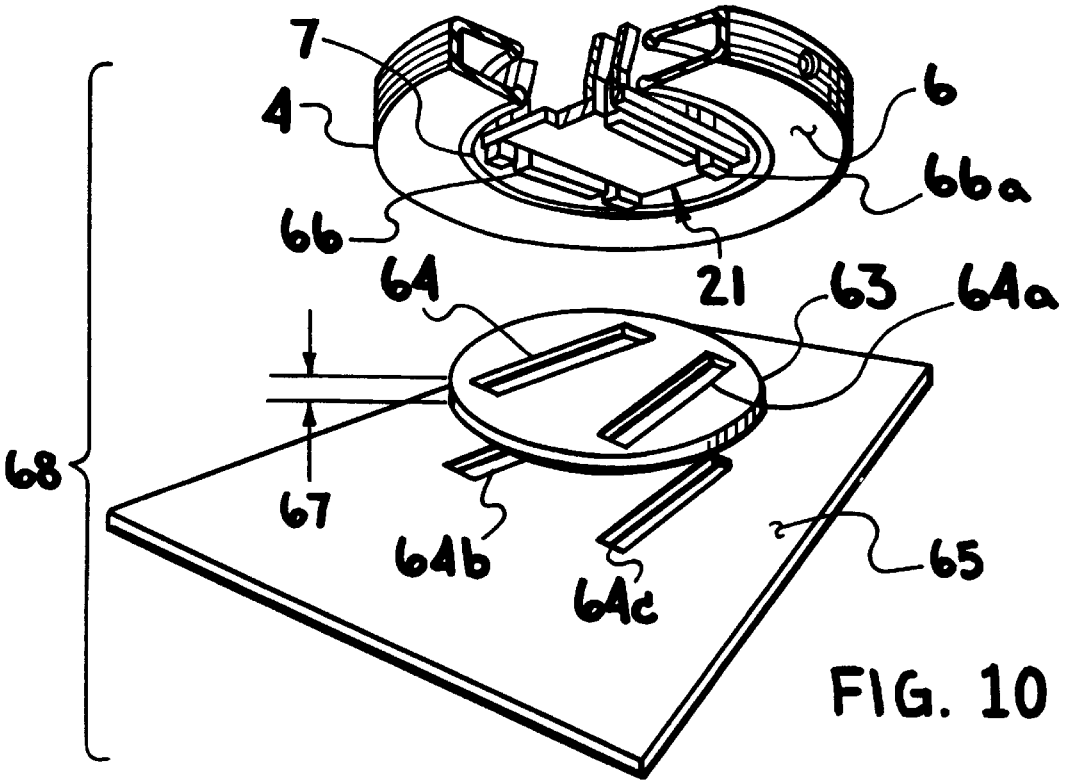
FIG. 10 is an exploded perspective view a partially completed inverted railroad rail support and a manufacturing jig plate.

In FIG. 10 a perspective view is shown of a concrete matrix mold formed by a rubber tire juxtaposed above a flat steel mold spacer plate 63 with railroad rail guide receiver slots 64 and 64*a* to mate with similar railroad rail guide receiver slots 64*b* and 64*c* in a bottom steel plate 65 of the concrete matrix mold. Upon assembly with the rubber tire 4 and the contained inverted railroad rail support means 21 with railroad rail guides 66 and 66*a*, a concrete matrix mold is formed in which the rubber tire top rim bead 7 and top sidewall 6 are essentially in a different horizontal plane by an amount equal to the thickness 67 of the flat steel mold spacer plate 63.

Figure 11:
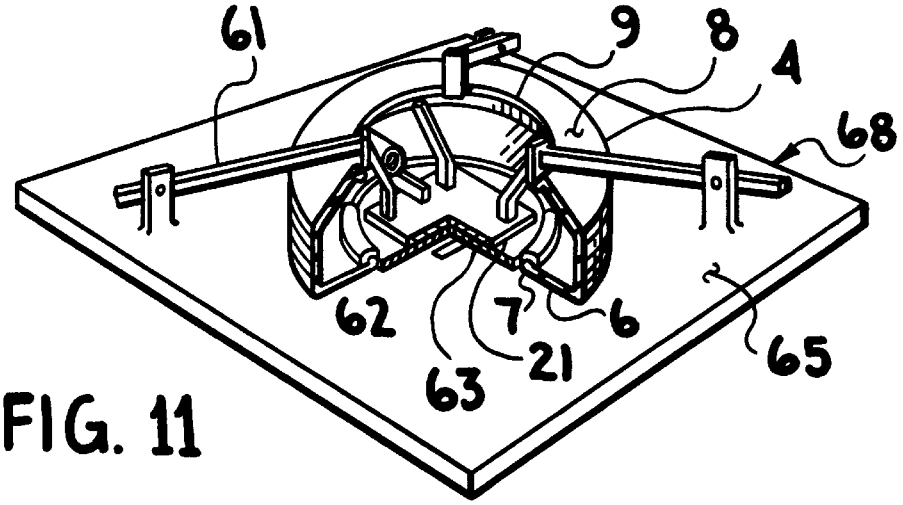
FIG. 11 is a perspective view a partially completed inverted railroad rail support on a manufacturing jig assembly.

In FIG. 11 a perspective quadrant cross-section view of an assembled concrete matrix mold 68 is shown, illustrating handles 61 lifting the bottom rim bead 9 and bottom sidewall 8 of the rubber tire 4 forming and holding the sidewall and rim bead in a truncated conical position. The top rim bead 7 and top sidewall 6 of the rubber tire 4 are horizontally disposed along the horizontally disposed surface 65 of the concrete matrix mold. Shown also are the inverted rail support means 21 resting on the flat steel mold spacer plate 63.

Figure 12:
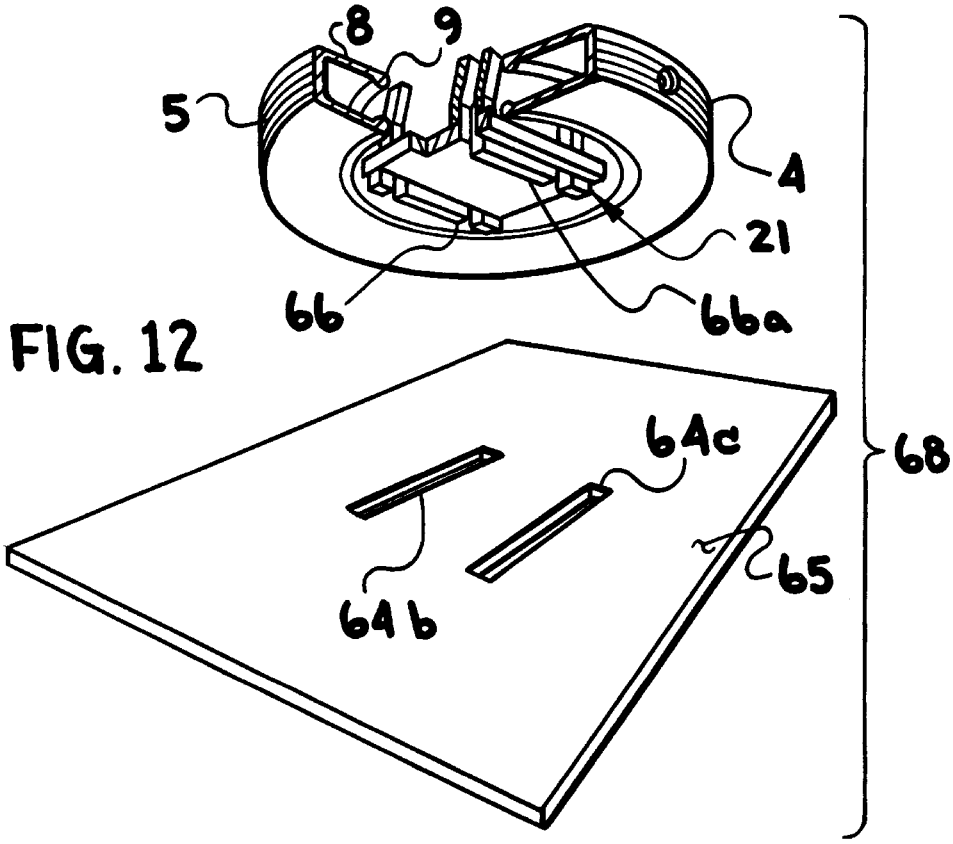
FIG. 12 is a perspective view of a second preferred embodiment of the invention.

In FIG. 12, a second preferred embodiment of the invention is disclosed in which the railroad rail guides 66 and 66*a* fit directly into the railroad rail guide receiver slots 64*b* and 64*c* in the bottom steel plate 65 of the concrete matrix mold 68. The rubber tire 4 and the inverted railroad rail support means 21, together with the horizontally disposed surface of the concrete matrix mold 68 form the cavity into which the concrete matrix 18 is poured. The rubber tire circumferential tread 5 is then subjected to external vibration, thus eliminating any entrapped air within the concrete matrix 18 through the open portion of the truncated cone formed by the bottom sidewall 8 and the bottom rim bead 9 of the rubber tire 4.

Figure 13:
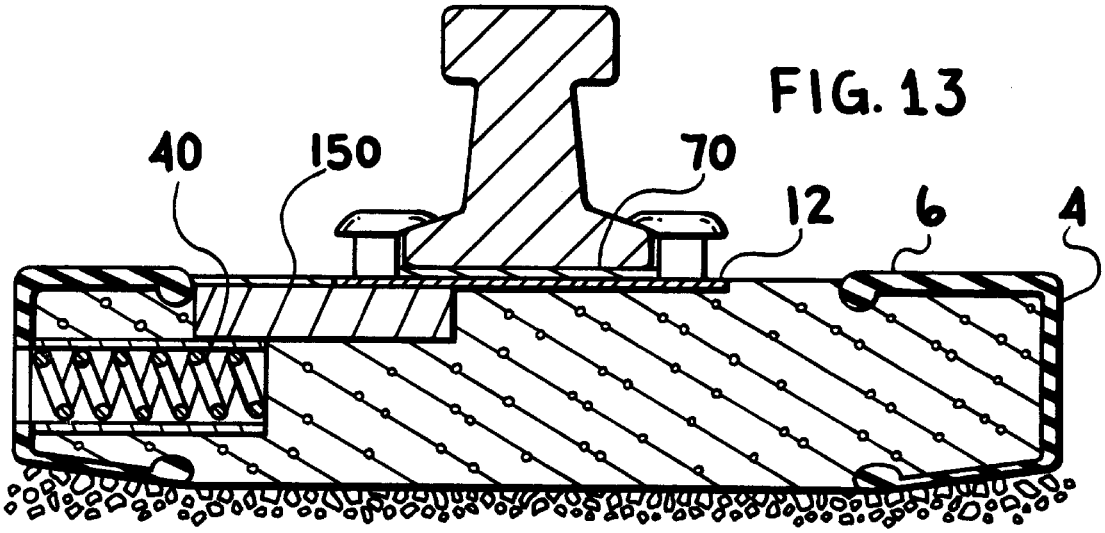
FIG. 13 is a diametral cross-sectional view of FIG. 3 taken along section line 6—6.

In FIG. 13, a diametral cross-section of FIG. 3 is shown taken along Section line 8—8 in which the female threaded member 40 is shown attached to the base of the top plate 12 by a vertically disposed attachment member 150. An insertable flat spacer 70, which is a third preferred embodiment of the invention, comprises a railroad rail load distribution and variation means by adjusting through the thickness of said flat spacer 70 the amount of force exerted on the top sidewall 6 of rubber tire 4.

Figure 14:
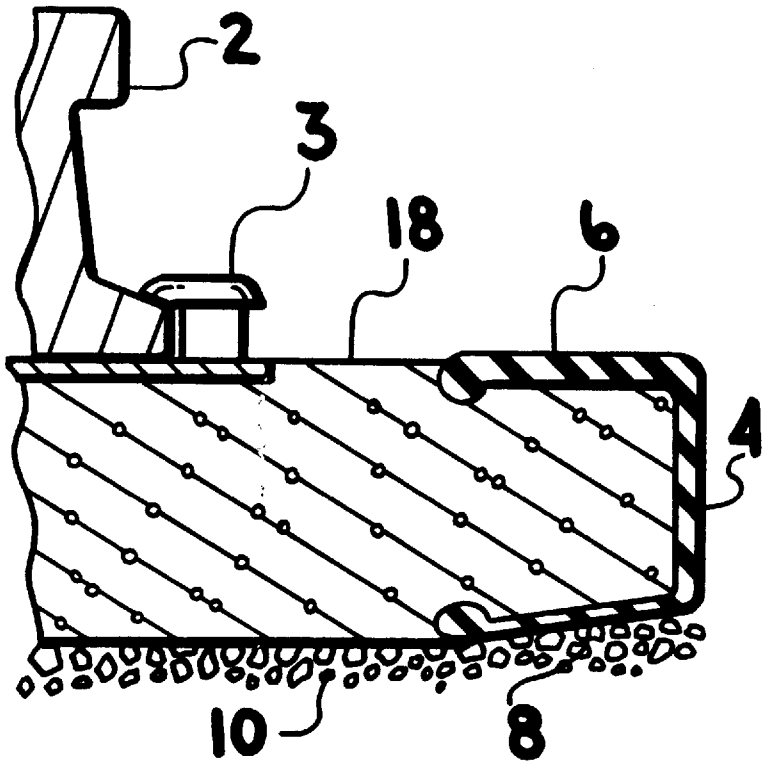
FIG. 14 is a reproduction of the right-hand portion of the cross-sectional view of FIG. 13.

In FIG. 14 a right-hand portion of the cross-section FIG. 6 is again shown with the railroad rail 2 resting in a locked position by the railroad spike means 3 and showing the rubber tire 4 with a top sidewall 6 in an uncompressed condition with the upper portion of the top sidewall 6 of the rubber tire 4 substantially above the top of the concrete matrix 18 and the bottom sidewall 8 of the rubber tire 4 in a substantially compressed condition resting on the aggregate comprising the railroad roadbed 10. It will be noted that the uncompressed thickness of the cross section of the upper tire sidewall 6 is substantially thicker than the compressed thickness of the bottom sidewall 8. It will be noted that the compressed thickness of the bottom sidewall is of a constant thickness nature, distributing the compressive loading from above evenly over the aggregate of the railroad roadbed 10. The compression of the rubber tire bottom sidewall 8 causes dampening and attenuates vibration and sound caused by a passing train.

Figure 15:
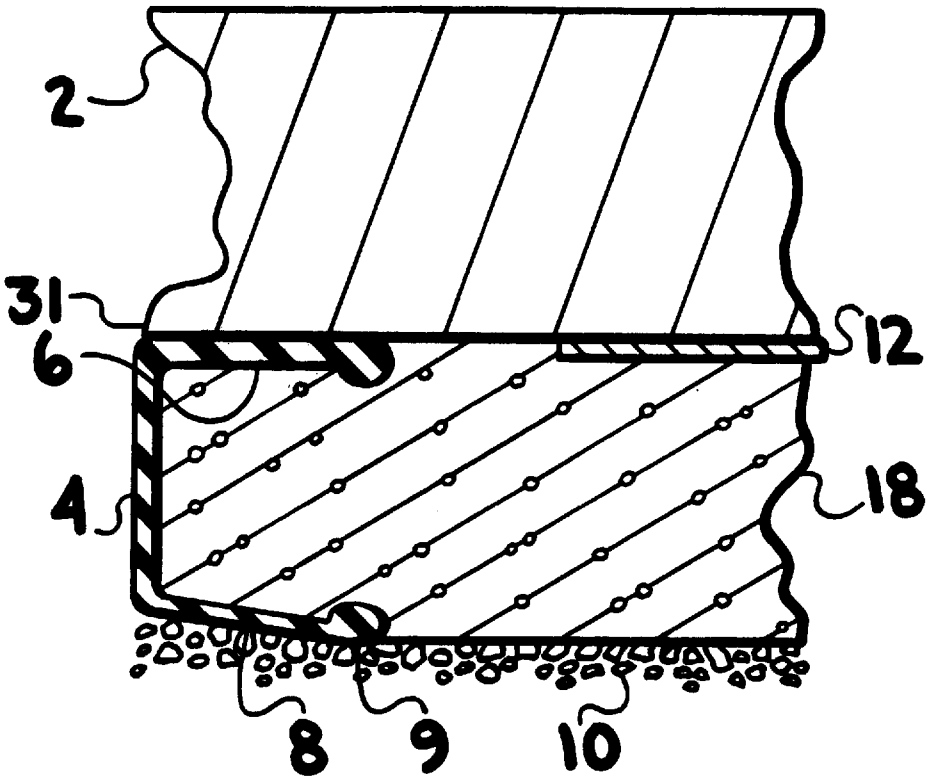
FIG. 15 is a partial cross-sectional view of FIG. 6 taken along section line 8—8.

In FIG. 15, which is a cross-section 8—8 of FIG. 6, the bottom flange 31 of railroad rail 2 is shown resting on the top sidewall 6 of rubber tire 4, compressing the top sidewall 6 of rubber tire 4 to approximately the same thickness as the bottom sidewall 8 of rubber tire 4 is compressed by virtue of being adjacent to the aggregate comprising the railroad roadbed 10. It will be noted that the compression force of a passing train over the railroad rail 2 is evenly distributed by the contact of the railroad rail bottom flange 31 across the top plate 12 of the railroad rail support member 1 and the top sidewall 6 of rubber tire 4. The compression of the rubber tire top sidewall 6, which has a natural capacity for vibration and sound absorption, by the force distributed over it causes a dampening of both sound and vibration caused by the passing train. Also shown in FIG. 15 is the truncated cone formed by the rubber tire 4 bottom rim bead 9 and the bottom tire sidewall 8.

The foregoing description of the present invention represents a preferred embodiment of the invention. Variations of design details within the scope of the disclosure will be obvious to those skilled in the art.

I claim:

1. A process for manufacturing a railroad rail support (1) including the steps of:

securing a bottom steel plate (65) of a concrete matrix mold (68) in a generally horizontal plane, said bottom steel plate having a pair of parallel elongated slots (64*b*, 64*c*) approximately the width of a railroad spike and spaced apart approximately the width of the bottom flange of a railroad rail;

attaching a circular mold spacer plate (63) on said bottom steel plate, said circular mold spacer plate having a diameter approximately the diameter of a rubber tire rim bead (7, 9), said circular mold spacer plate having a pair of parallel elongated slots (64, 64*a*) matching the width and spacing of the slots in the bottom steel plate;

forming a plurality of elongated tubular channels (30) into a general V-shape comprising a first vertical portion (32) and a second sloping portion (37);

said vertical portions of the tubular channel disposed into apertures in a first top plate (12) of a rail support means (21) in a parallel pattern spaced apart approximately the width of the bottom flange of a railroad rail and matching the parallel slots (64, 64*a*) in the mold spacer plate (63);

placing a plurality of railroad rail guides (66) on the top plate (12), said rail guides configured to match and enter the parallel slots (64, 64*a*) in the mold spacer plate, and said guides being interrupted at the tubular channels (30);

placing a vertically-disposed attachment member (150) between the top plate (12) and a transverse tube including a female threaded member (40) whereby said female threaded member is positioned at a radial distance of approximately the radius of a rubber tire (4);

pivotally attaching a plurality of handles (61) in a radial pattern on the bottom steel plate (65) and disposed about the circular mold spacer plate (63) to form a manufacturing jig assembly:

securing the first top plate (12) onto the circular mold spacer plate (63) with the railroad rail guides (66, 66*a*) extending into the parallel slots (64, 64*a*, 64*b*, 64*c*);

positioning a first rubber tire (4) to form part of said concrete matrix mold (68) with the top tire rim bead (7) adjacent the circumference of the circular mold spacer plate (63) with the female threaded member (40) extending through a hole (41) in the tire circumferential tread (5) and with the top sidewall (6) against the bottom steel plate (65);

engaging the handles (61) with the tire bottom rim bead (9), lifting said bottom rim bead and flexing the bottom tire sidewall (8) to axially separate the top and bottom rim beads approximately to the height of the open ends (60) of the tubular channels (30);

pouring a concrete matrix into the interior of the first rubber tire (4) and the rail support means (21) to form a first contiguous rail support (11);

positioning a second rubber tire (4) to form part of said concrete matrix mold;

engaging the handles (61) with the second tire bottom rim bead (9), lifting said bottom rim bead and flexing the bottom tire sidewall (8) to axially separate the top and bottom rim beads approximately to the height of the open ends (60) of the tubular channels (30);

pouring a concrete matrix into the interior of the second rubber tire (4) and the rail support means (21) to form a second contiguous rail support 11*a*; and threadably engaging an elongated horizontal steel tube (47) into the respective female threaded members (40) to position the first and second rail supports at approximately the distance between a pair of railroad rails.

2. A process for manufacturing a railroad rail support according to claim 1 in which the horizontal steel tube (47) terminates at either end in opposite screw threads, and the respective female threaded members (40) have corresponding opposite screw threads, whereby rotation of the horizontal steel tube (47) laterally adjusts the rail support spacing.

3. A process for manufacturing a railroad rail support according to claim 1 in which the handles (61) lift the respective bottom tire rim beads, flexing the respective bottom tire sidewalls (8, 8*a*) to a truncated conical shape.

4. A process for manufacturing a railroad rail support according to claim 1 in which the generally V-shape of the tubular channels (30) have an angle of at least 30° between respective first vertical portions (32) and second sloping portions (37).

5. A process for manufacturing a railroad rail support (1) including the steps of:

placing a first rail support (21) means on a generally flat surface;

placing a first rubber tire (4) on the generally flat surface with one sidewall against said flat surface;

filling the first tire (4) with a concrete matrix;

placing a second rail support (21*a*) means on a generally flat surface;

placing a second rubber tire (4*a*) on the generally flat surface with one sidewall against said flat surface;

filling the second tire (4*a*) with a concrete matrix and connecting the first and second rail support means (21, 21*a*) at approximately the distance between a pair of railroad rails with a strut in the form of an elongated horizontal steel tube (47).

6. A process for manufacturing a railroad rail support according to claim 5 in which the first and second rail support (21, 21*a*) means includes a threaded member extending through a hole (41) in the tire circumferential tread (5); and threadably engaging an elongated horizontal steel tube (47) into the respective female threaded members (40, 40*a*) to position the first and second rail support means (21, 21*a*) at approximately the distance between a pair of railroad rails.

7. A process for manufacturing a railroad rail support according to claim 5 in which the horizontal steel tube (47) includes a means for adjusting the distance between a pair of railroad rails.

8. A process for manufacturing a railroad rail support according to claim 5 in which the first and second top plates (12) of the first and second rail support means (21, 21*a*) includes a flange (70) disposed between the first and second top plates (12) and the bottom flanges of respective railroad rails.

9. A process for manufacturing a railroad rail support according to claim 5 in which the poured concrete matrix (18, 18*a*) is densified, while fluid, by applying vibration to the exposed treads (5, 5*a*) of the rubber tires (4, 4).

10. A process for manufacturing a railroad rail support according to claim 5 in which air trapped within the poured fluid concrete matrix is eliminated by lifting respective bottom tire sidewalls (8, 8*a*) by respective lifting handles (61) to form vertically truncated conical shapes with open tops therethrough.

11. A process for manufacturing a railroad rail support according to claim 5 in which the concrete matrix is poured into an open top cavity formed by axial separation of top and bottom tire rim beads (7,9).

12. A process for manufacturing railroad rail support according to claim 5 which a roadbed aggregate (10) anchorage means comprises a exposed demolded bottom surface of the concrete aggregate (18, 18*a*) of the railroad rail support said concrete aggregate left exposed following concrete aggregate infilling of the first and second tires and subsequent demolding removal of a circular mold spacer plate (63).

13. A process for manufacturing a railroad rail support according to claim 5 in which a roadbed aggregate(10) anchorage means comprises an exposed bottom tire sidewall (8, 8*a*) and bottom tire rim (9, 9*a*) of the first and second rubber tires of the railroad rail support, said bottom tire sidewalls and said bottom tire rims left exposed during concrete infilling of the said tires.

* * * * *